US008863785B2

(12) United States Patent
Bruske et al.

(10) Patent No.: US 8,863,785 B2
(45) Date of Patent: Oct. 21, 2014

(54) MOUNTING DEVICE FOR ALL-STEEL CARD CLOTHINGS

(75) Inventors: Johannes Bruske, Albstadt (DE); Benjamin Beck, Bitz (DE); Carmen Sautter, Balingen (DE)

(73) Assignee: Groz-Beckert KG, Albstadt (DE)

( * ) Notice: Subject to any disclaimer, the term of this patent is extended or adjusted under 35 U.S.C. 154(b) by 886 days.

(21) Appl. No.: 12/965,025

(22) Filed: Dec. 10, 2010

(65) Prior Publication Data

US 2011/0139291 A1 Jun. 16, 2011

(30) Foreign Application Priority Data

Dec. 16, 2009 (EP) ..... 09015527

(51) Int. Cl.
*B21F 45/10* (2006.01)
*D01G 15/84* (2006.01)
*D01G 15/92* (2006.01)

(52) U.S. Cl.
CPC ..... *D01G 15/92* (2013.01)
USPC ..... 140/97; 19/114

(58) Field of Classification Search
USPC ..... 140/97; 19/114, 98; 242/419.4
See application file for complete search history.

(56) References Cited

U.S. PATENT DOCUMENTS

| | | | | |
|---|---|---|---|---|
| 2,000,070 | A | 5/1935 | Flynn | |
| 2,384,650 | A | 9/1945 | Sjogren | |
| 4,350,432 | A | 9/1982 | Kondoh | |
| 4,643,367 | A | 2/1987 | Waters et al. | |
| 7,360,735 | B2 | 4/2008 | Schneider et al. | |
| 7,395,581 | B2 | 7/2008 | Hosel et al. | |
| 7,673,374 | B2 | 3/2010 | Hosel | |
| 7,917,999 | B2 * | 4/2011 | Leder et al. | 19/114 |
| 2004/0056137 | A1 | 3/2004 | Bocht et al. | |
| 2006/0000937 | A1 | 1/2006 | Schneider et al. | |
| 2009/0293232 | A1 * | 12/2009 | Breuer et al. | 19/114 |
| 2011/0138580 | A1 | 6/2011 | Conzelmann et al. | |

FOREIGN PATENT DOCUMENTS

| | | |
|---|---|---|
| CH | 255376 | 6/1948 |
| DE | 10061286 | 4/2002 |
| DE | 102004004433 | 8/2005 |
| DE | 102004055310 | 5/2006 |
| EP | 1399901 | 3/2004 |
| GB | 564214 | 9/1944 |
| JP | 55111974 A | 8/1980 |
| WO | 0246505 | 6/2002 |
| WO | 2004035886 | 4/2004 |

OTHER PUBLICATIONS

International Search Report dated May 7, 2010 relating to European Patent Application 09015527.6 (5 pages).
English translation of Japanese Patent Application No. 2010-278944 Office Action from the Japan Patent Office; dated Jul. 10, 2012; 13 pgs.

* cited by examiner

*Primary Examiner* — Shelley Self
*Assistant Examiner* — Mohammad I Yusuf
(74) *Attorney, Agent, or Firm* — Fitch, Even, Tabin & Flannery LLP

(57) ABSTRACT

In the mounting device (1) in accordance with the invention, the mounting arm (4) is held on a guide arrangement (11), the guide direction of said guide arrangement being oriented parallel to the rotational axis of the drum (3) to be fitted. A force measuring arrangement 21 is provided to detect the tensile force in the profile wire 9, said force measuring arrangement detecting the total force acting on the mounting arm (4), at least in longitudinal direction of the wire. In doing so, essentially all the forces acting on the profile wire (9) are detected, namely, the braking forces of a brake arrangement (25) as well as the braking forces of other arrangements such as, for example of alignment arrangements 28, tilting arrangements 32 or the like.

14 Claims, 4 Drawing Sheets

MOUNTING DEVICE FOR ALL-STEEL CARD CLOTHINGS

CROSS-REFERENCE TO RELATED APPLICATION

The present application claims the priority of European Patent Application No. 09 015 727.6, filed Dec. 16, 2009, the subject matter of which, in its entirety, is incorporated herein by reference.

BACKGROUND OF THE INVENTION

The invention relates to a mounting device for mounting profile wire on drums.

In textile technology, a carding machine or carder (briefly: card or teasel) is used to separate, order, for example to render homogeneous and/or parallel, fibers or fiber material such as, for example, wool, cotton or the like. The product of a carding process is a fibrous web. This fibrous web consists of a loose assembly of ordered individual fibers that can be used to create a non-woven or formed fabric. The fibrous web is obtained in that the fibers are removed with the use of removing means from a large carding drum also referred to as a tambour, and then combined.

In most cases, the carding machine comprises a number of different drums or rollers, each being provided with outward-pointing sharp barbs or teeth. Depending on the purpose of use, the number of sharp tips per unit area varies. Likewise, the form and alignment of the tips may vary.

At least one of the mentioned drums, for example the tambour, is provided with an all-steel card clothing. The latter consists of a profile wire with a cross-section having a rectangular section and a blade section. The blade section is arranged on the radially outer side and is provided with a sawtooth profile, for example. The profile wire that is entirely arranged on a helical line is preferably subjected to longitudinal tension. The ends of said profile wire are securely attached to the drum, for example by soldering, welding or in another manner.

Due to wear, it may be necessary to replace the all-steel card clothing. Upon removal of the old clothing, a new profile wire will be mounted on the drum. For mounting the profile wire of the all-steel card clothing, mounting devices are used, said devices being disposed to control, in particular, the tension with which the profile wire is wound.

For example, document CH 255376 discloses a mounting device comprising a frame in which the drum to be fitted with the all-steel card clothing is arranged horizontally and in a rotatable manner. A drive motor causes the drum to rotate in a controlled manner. The profile wire used to produce the all-steel card clothing is kept ready for use on a feed spool. From it, said wire moves over the mounting device onto the drum. The mounting device comprises a guide arm supported on a frame, said guide arm decelerating the profile wire by means of a brake arrangement. In addition, a pressure foot is provided on the arm, said pressure foot pressing the convolutions located on the drum in a gapless manner against each other.

The tension in longitudinal direction applied to the profile wire is determined and defined via the brake arrangement. However, in doing so, the wire tension prevailing in the convolutions of the profile wire that are located on the drum is not detected precisely. The brake force display indicates only the braking force. Additional forces acting on the profile wire, e.g., at the deflecting point or at the pressure foot, are not taken into account.

Document EP 1 554 418 B1 suggests a device 5 for mounting a card clothing, said device comprising a brake unit 20 that can be shifted back and forth parallel to the card clothing. The brake unit 20 is arranged on a carriage structure 28. With the use of a force measuring arrangement 34, the occurring support force is measured between an abutment arrangement 33 and the carriage structure 28 and used as a direct measure for the force of the preliminary tension of the all-steel card clothing.

Also in this instance, external influences that could change the force of the preliminary tension upstream of and/or downstream of the brake arrangement are not detected.

Considering this, it is the object of the invention to provide a mounting device featuring the improved measurement of the force that is effective when the profile wire is being mounted.

SUMMARY OF THE INVENTION

The above object generally is achieved according to the present invention with a mounting device that comprises a frame that supports a mounting arm in a movable manner. Among other things, this mounting arm is disposed to guide the profile wire in a controlled manner onto the drum in order to produce an all-steel card clothing. In accordance with the invention, a force measuring arrangement for the determination of the force existing in the profile wire as it is being placed on the drum is provided, said force measuring arrangement being disposed to measure the force with which the mounting arm is supported by the frame, optionally via a guide arrangement. In doing so, at least in one preferred embodiment, the term "force" is understood to mean the force component that is directed parallel to the profile wire moving onto the drum. Alternatively, it is also possible to detect all the force components instead of this single force component, i.e., to detect the amount and direction of the total effective force and to at least calculate, as needed, the desired components based on the resultant force vector. To accomplish this and also simply for display of the measured force components, it is possible to provide an appropriate evaluation arrangement, display arrangement or the like.

Preferably, the mounting arm supports several components that guide or influence the profile wire. For example, the mounting arm may support a brake arrangement. This brake arrangement may comprise brake rollers or brake jaws that act—with a defined longitudinal force—on the profile wire that is passing through.

Upstream of the brake arrangement, the mounting arm may comprise guide rollers that are disposed, for example, to rotate the profile wire out of the position in which it moves off the feed spool into a mounting position in which it is wound on the drum. In doing so, the profile wire experiences a rotation of 90 degrees about its longitudinal axis, for example.

Furthermore, the mounting arm may support an alignment arrangement. Said alignment arrangement may be provided, in particular, for straightening the profile wire moving through the mounting device and for being used to produce the all-steel card clothing. The alignment arrangement may comprise several rollers arranged in a zigzagging manner with the profile wire passing between said rollers.

Furthermore, the mounting arm may support a tilting device. The tilting device may be disposed to change the orientation of the profile wire, for example. The tilting device controls the direction in which the profile wire is aligned, for example by guide means that act on the lateral surfaces of the profile wire. In order to influence the alignment in a targeted manner, the guide means may exert a braking effect on the profile wire.

It is also possible to arrange additional means on the mounting arm, such additional means being, for example, deflecting rollers and/or rotatably supported guide means that affect the arrangement of the profile wire on the drum.

There are several options of detecting the entire force acting on the mounting arm or of detecting at least the magnitude of the force component acting on the mounting arm in longitudinal direction of the profile wire. A first option is the arrangement of the force measuring arrangement so as to be active between the mounting arm and the guide arrangement that is used to support the mounting arm on the frame. To accomplish this, the mounting arm may be movably connected with the guide arrangement in longitudinal direction of the profile wire. The force measuring arrangement is then effective in longitudinal direction of the profile wire and detects minimal longitudinal displacements of the mounting arm relative to the guide arrangement.

It is also possible to detect the force acting in the guide arrangement itself. In doing so, preferably only the force component active transversely to the guide rail between the guide carriage and the guide rail is being detected. If, for example, the guide carriage is supported via rollers on the guide rail, the forces occurring on the bearing of the rollers can be detected by appropriate force sensors in order to determine the sought force.

Furthermore, it is possible to measure the force occurring between the guide rail and the frame. For example, force sensors may be used to connect both ends of the guide rail with the frame. The sum of the partial forces that are output by the force sensors then corresponds to the force acting on the mounting arm.

It is considered to advantageous if the guide arrangement, by way of which the mounting arm can be moved parallel to the drum, enables pivoting of the mounting arm about the longitudinal axis of the guide rail. In doing so, the mounting arm may freely align itself corresponding to the moving direction of the profile wire that is moving onto the drum.

Additional details of advantageous embodiments of the invention are the subject matter of the specification, the drawing or the claims. The description is restricted to essential aspects of the invention and to miscellaneous situations. The drawings and the knowledge of the person skilled in the art are intended to supplement the description.

The drawings show exemplary embodiments of the invention.

DETAILED DESCRIPTION OF THE INVENTION

Figure 1:
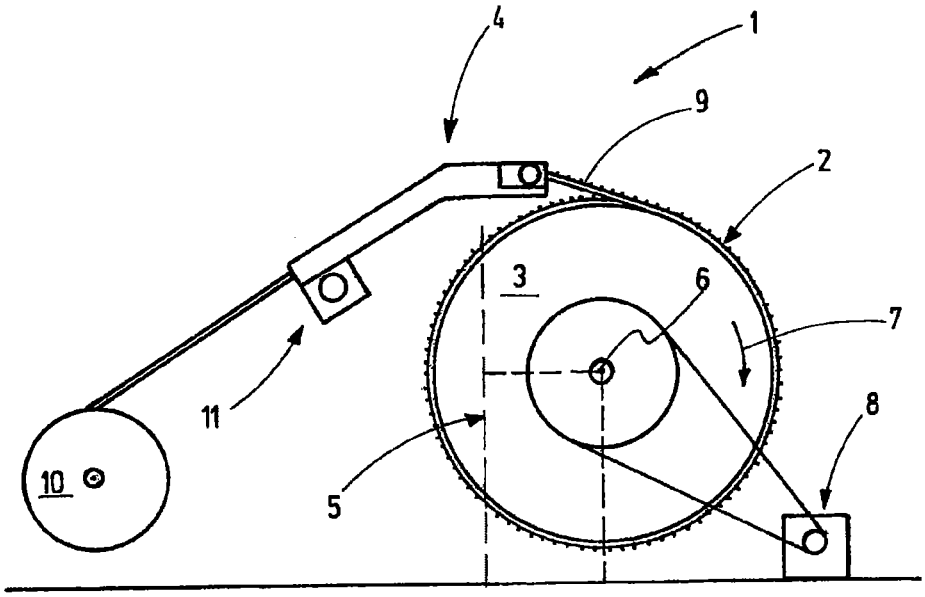
FIG. 1 is a schematized representation of a mounting device for mounting a profile wire on a carding drum.

FIG. 1 shows a mounting device 1 for mounting a profile wire 9 on a drum 3. The drum 3 is a carding drum of a carding machine. The mounting device 1 comprises at least one mounting arm 4 and a frame shown shaded in FIG. 1, said frame being disposed to support the mounting arm 4. Depending on the mounting conditions, the drum 3 may be rotatably supported in the frame 5, wherein the rotational axis 6 is preferably oriented in horizontal direction. This is the case when the mounting operation takes place outside a carding machine. If the mounting operation takes place inside a carding machine, the drum 3 is rotatably supported by the frame 5 of the carding machine. In order to drive the drum 3 in a rotating manner in the direction of arrow 7 in FIG. 1, a motor 8 is provided, said motor being in a driving relationship with the drum 3, e.g., via a chain drive.

Figure 2:
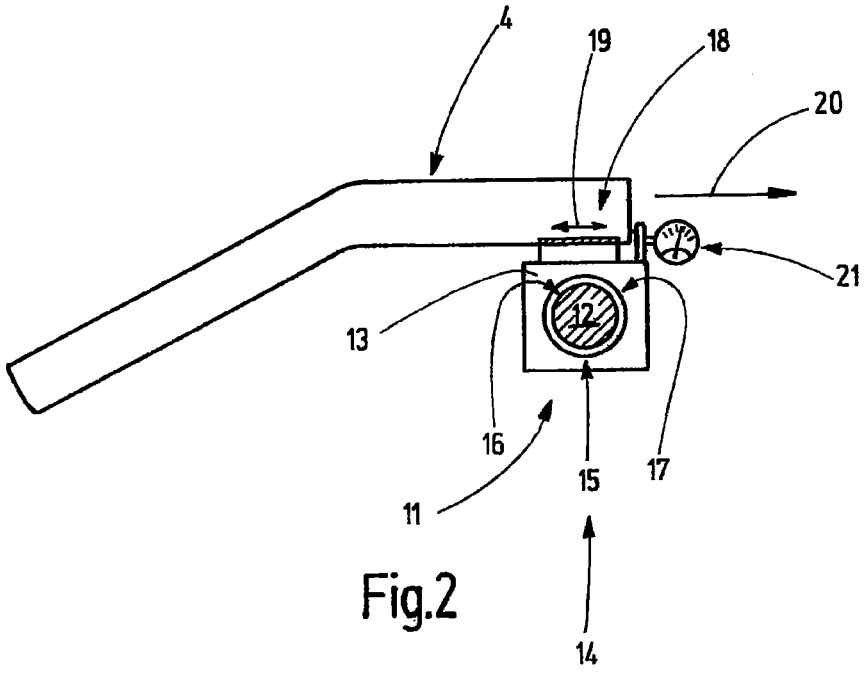
FIG. 2 is a schematized lateral view of the mounting arm and its guide arrangement.

The all-steel card clothing 2 preferably comprises a profile wire 9 wound in a gapless manner on a drum 3, said profile wire being delivered by a feed spool 10. In the case of certain applications it may be necessary that a distance be provided between the lateral surfaces of the mounted profile wire 9. To accomplish this, the drum 3 may have spaced-apart grooves that accommodate the profile wire 9. The feed spool 10 may be accommodated by the frame 5 or be supported in another manner. If the motor 8 drives the drum 3 so that said drum will rotate, said drum will pull the profile wire 9 off the feed spool 10 by way of the mounting arm 4. In doing so, the profile wire is gradually wound on the entire generated surface of the drum 3. Accordingly, the mounting arm 4 follows the winding operation and, to do so, is axially adjusted or advanced thereto, i.e., parallel to the rotational axis 6. To do so, a guide arrangement 11 holds the mounting arm in a movable manner on the frame 5. As schematically indicated, for example in FIG. 2, the guide arrangement 11 comprises at least one guide rail 12 as well as one guide carriage 13. In doing so, the guide rail 12 is oriented preferably parallel to the rotational axis 6. The guide arrangement 11 may be configured as a sliding guide or also as a rolling element guide. The guide rail 12 may have a circular diameter or a diameter different therefrom. In the present exemplary embodiment, the guide carriage 13 is supported via several rollers 14 on the guide rail 12, of which FIG. 2 shows a first roller 15, a second roller 16 and a third roller 17.

In the presented exemplary embodiment, the guide carriage 13 may pivot about the guide rail 12 so that the mounting arm 4 automatically adapts itself regarding its orientation to the moving direction of the profile wire 9 and thus to the diameter of the drum 3. Alternatively, however, it is also possible to provide a guide arrangement that does not allow any rotation of the guide carriage 13 relative to the guide rail 12.

Figure 4:
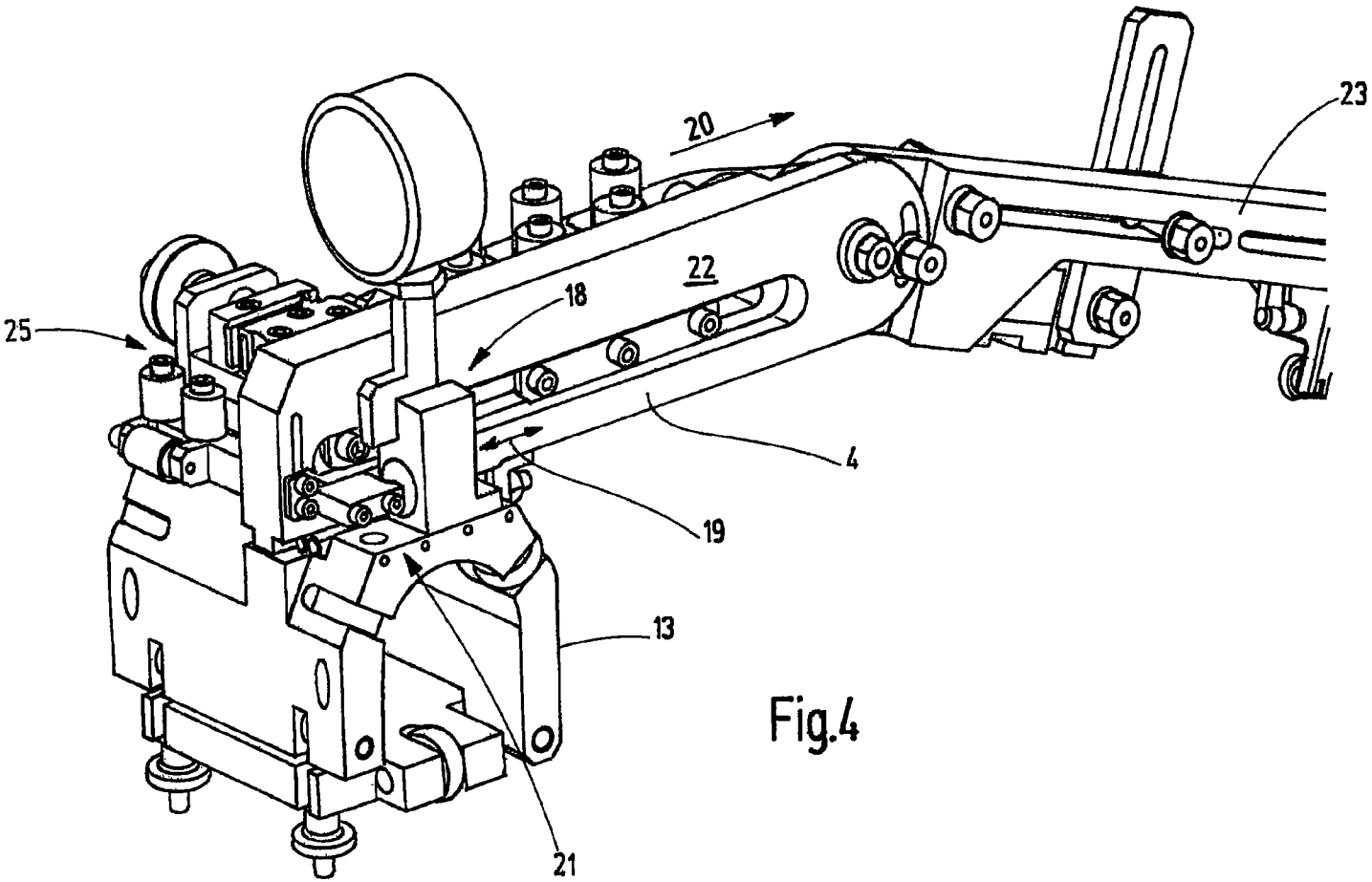
FIG. 4 is a perspective representation, viewed from another direction, of the mounting arm in accordance with FIG. 3.

The guide arm 4 is held on the guide carriage 13. In FIG. 4, this is accomplished by a connecting arrangement 18 that allows minimal movability of the mounting arm 4 relative to the guide carriage 13 in the direction of arrow 19. The connecting arrangement 18 is also specifically shown by FIG. 4. The direction marked by arrow 19 corresponds to the longitudinal direction of the profile wire as marked by the arrow 20 in FIGS. 2 and 4.

A hydraulically operating force measuring arrangement 21, for example, is arranged between the mounting arm 4 and the guide carriage 13. This force measuring arrangement may be disposed to indicate a displacement of the mounting arm 4 relative to the carriage 13 in the direction of arrow 19 against the force of a precisely operating spring element.

Alternatively, the connecting arrangement 18 may also be replaced by a deformable element that connects the mounting arm 4 with the guide carriage. Suitable deformation sensors such as, for example, strain gauges or the like, may detect the deformation, said deformation being proportional to the force, and indicate said deformation, for example, by means of an electrical display arrangement. It is also possible to display the deformation of such spring elements by means of mechanical indicating arrangements, for example, in the form of link mechanisms.

Figure 3:
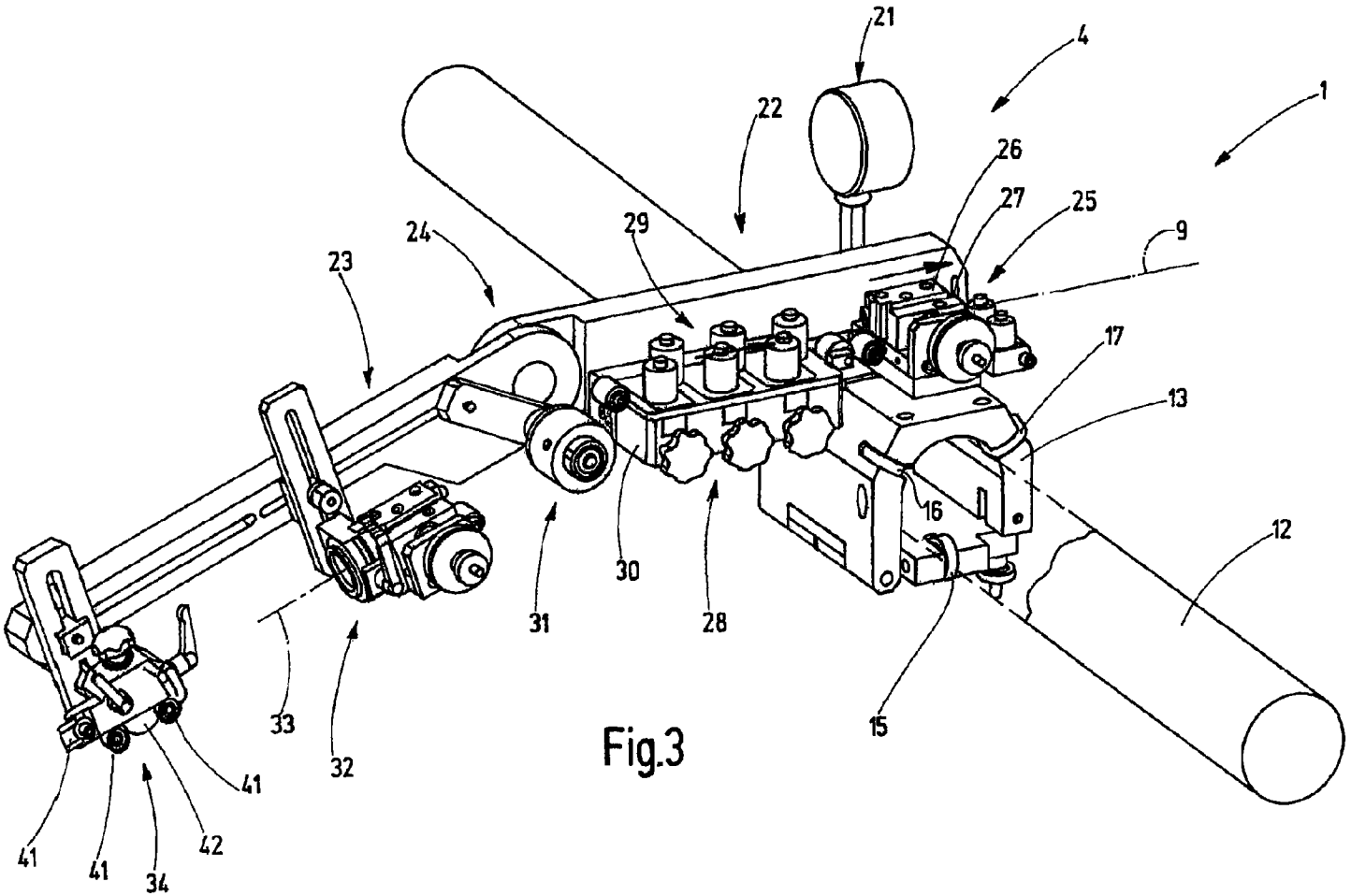
FIG. 3 is a perspective representation, in slightly greater detail, of the mounting arm and its guide arrangement.

For further explanation of the mounting device, reference is made to FIGS. 3 and 4. These show, in particular, the mounting arm 4. It is possible, as illustrated, for said mounting arm to comprise a first member 22 connected with the guide carriage 13 and a second member 23, said second member being connected with the first member 22, for example, by means of a hinge 24. Various arrangements may be held on the various members 22, 23 of the mounting arm 4. For example, the first member 22 may be associated with a brake arrangement 25 comprising a stationary brake jaw 26 and a movable brake jaw 27. It is possible to bias the movable brake jaw 26 relative to the stationary brake jaw 26 by means of a not specifically illustrated spring means. The brake arrangement 25 may be designed as shown or also in any other suitable manner. Said latter brake arrangement is disposed to inhibit the passage of the profile wire in order to impart said wire with a defined tension.

At a suitable point, for example on the first member 22, it is possible to additionally arrange another arrangement such as, for example, an alignment arrangement 28. The alignment arrangement 28 is intended, in particular, to eliminate any bending potentially existing in the profile wire. This may be accomplished with alignment rollers 29 that are arranged on a common carrier 30 with their rotational axes being parallel to each other. If needed, the individual alignment rollers 29 may be arranged so as to be adjustable in order to adapt them to various profile wires.

It is possible to arrange a deflecting roller 31 on or between the members 22, 23, said deflecting roller enabling the profile wire to move over said deflecting roller on its path along the mounting arm 4. It is possible to arrange a tilting device 32 on the second member 23 upstream of the deflecting roller. Said tilting device is preferably intended to eliminate or suitable generate a torque existing in the profile wire. To accomplish this, the tilting device 32 may comprise one or more jaws, profile pieces, rollers or the like that can be brought into positive engagement with the profile wire, said means imparting the profile wire with a desired angular position relative to the longitudinal axis 33 shown dotted in FIG. 3. The tilting device 32 may be provided with various adjustment means in order to adapt to current situations and be able to perform the appropriate adjustments.

The mounting arm 4 may support other devices or arrangements such as, for example, the arrangement 34 that is disposed to guide the profile wire 6 in the immediate vicinity of the drum 3. To do so, the arrangement 34 comprises a means 41 that is seated on the surface of the drum 3 during the mounting operation. This means 41 may be arranged so as to be rotatable or be arranged stationarily on the arrangement 34. If the means 41 is rotatably supported, it preferably has the form of a roller so that the arrangement 34 can be moved with minimal friction over the surface of the drum 3. A guide means 42, for example having the form of a roller, may be arranged between two rotatably supported support means 41, said roller applying a pressure to the all-steel card clothing during the mounting operation. This guide roller 42 ensures that—in the case of an all-steel card clothing 2 when the profile wire 9 is to be mounted without gaps—the successive convolutions of the profile wire 9 are lined up in contact with each other next to each other. If the means 41 is permanently arranged on the arrangement 34, said means may be configured as a thin guide pin and take over the pressure function of the guide means 42. A means 41 that is stationarily arranged on the arrangement preferably is used when the all-steel card clothing 2 is mounted in the end region of the drum 3. This also enables the gapless mounting of the all-steel card clothing 2 in the region of the drum 3 where there is no longer any support surface for thicker support means 41. The arrangement 34 may comprise rotatably supported as well as stationarily arranged means 41. In this instance, the arrangement may comprise adjustment means that enable the alternating use of these means 41. With the use of these adjustment means, the means 41 may be additionally adjusted or rotated in any direction so that, depending on the adjustment of the mounting arm 4, the means 41 abut optimally against the surface of the drum 3.

A profile wire 9 is mounted on a drum 3 as follows:

In operating mode, the profile wire 9 moves over the mounting arm 4 onto the slowly rotating drum 3 that is driven by the motor 8, as is shown in FIG. 1. Said drum then pulls the profile wire 9 through the mounting arm 4. As shown in particular in FIGS. 3 and 4, various arrangements and elements on the mounting arm 4 act on the profile wire 9. These arrangements and elements include, for example, the brake arrangement 25, the alignment arrangement 28, the tilting device 32 and, optionally, additional deflecting rollers, guide rollers or other parts. All the mentioned arrangements and other arrangements in contact with the wire ultimately influence the longitudinal tensile force of the profile wire 9 effective between the drum 3 and the mounting arm 4. The corresponding counter force acting cumulatively on the mounting arm 4 is detected by the force measuring arrangement 21. This force measuring arrangement ultimately measures the force with which the force measuring arm 4 abuts against the guide carriage 13. This force is essentially equal to the tensile force acting in the profile wire.

By applying the introduced principle, it is possible to precisely measure the tensile force active in the profile wire. In particular, measuring problems caused by an easy or hard passage of the wire through the alignment arrangement 28 or the tilting device 32 are of no consequence in view of the measured result. Measuring is simple and accurate.

Figure 5:
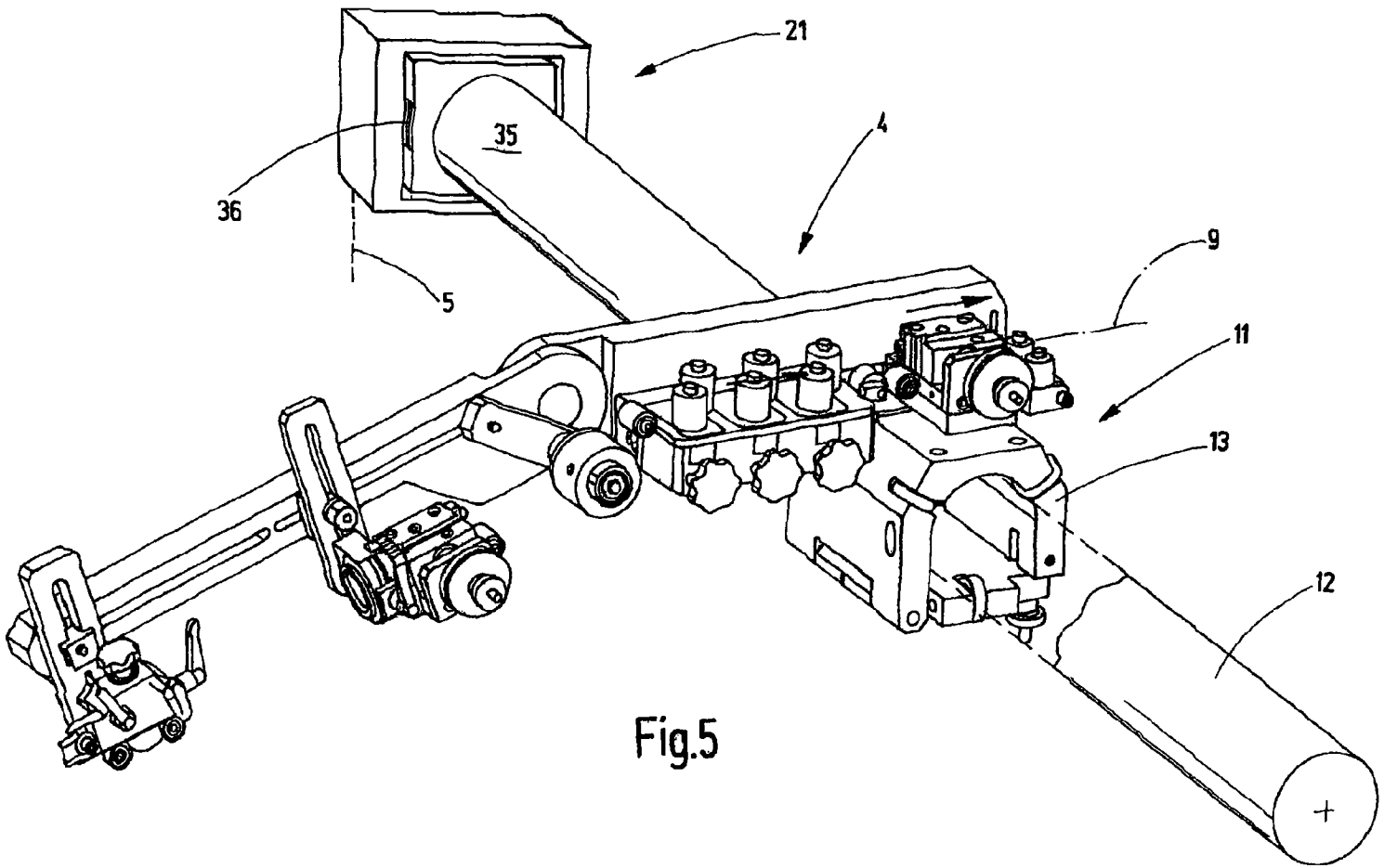
FIG. 5 is a perspective representation of a modified embodiment of the mounting device in accordance with the invention.

FIG. 5 shows a modified embodiment for implementing the measuring principle in accordance with the invention. Referring to the embodiment in accordance with FIG. 5, the previous description initially applies analogously, while the same reference signs have been used as basis. However, different from the above description, the measuring arrangement 21 is not arranged between the mounting arm 4 and the guide carriage 13 but between the guide arrangement 11 and the frame 5. In this case, the force measuring arrangement 21 comprises at least two force sensors by means of which the guide rail 12 is connected on both its ends to the frame 5. In FIG. 5, this is illustrated only for one end 35 with reference to a force sensor 36. The opposite end 37 of the guide rail 12 is then connected—via exactly such a force sensor 36—with the frame 5. The two force sensors 36 then indicate, cumulatively, the force with which the guide rail 12 abuts against the frame 5. This force, in turn corresponds to the tensile force prevailing in the profile wire 9.

In the mounting device 1 in accordance with the invention, the mounting arm 4 is held on a guide arrangement 11, the guide direction of said guide arrangement being oriented parallel to the rotational axis 6 of the drum 3 to be fitted. A force measuring arrangement 21 is provided to detect the tensile force in the profile wire 9, said force measuring arrangement detecting the total force acting on the mounting arm 4, at least in longitudinal direction of the wire. In doing so, essentially all the forces acting on the profile wire 9 are detected, namely, the braking forces of a brake arrangement 25 as well as the braking forces of other arrangements such as, for example of alignment arrangements 28, tilting arrangements 32 or the like.

It will be appreciated that the above description of the present invention is susceptible to various modifications, changes and modifications, and the same are intended to be comprehended within the meaning and range of equivalents of the appended claims.

LIST OF REFERENCE NUMERALS

1 Mounting device
2 All-steel card clothing
3 Drum
4 Mounting arm
5 Frame
6 Rotational axis
7 Arrow
8 Motor
9 Profile wire
10 Feed spool
11 Guide arrangement
12 Guide rail
13 Guide carriage
14 Rollers
15 First roller
16 Second roller
17 Third roller
18 Connecting arrangement
19 Arrow indicating movability of the mounting arm
20 Arrow for the longitudinal and advance directions of the profile wire
21 Force measuring arrangement
22 First member
23 Second member
24 Hinge
25 Brake arrangement
26 Stationary brake jaw
27 Movable brake jaw
28 Alignment arrangement
29 Alignment rollers
30 Carrier
31 Deflecting roller
32 Tilting device
33 Longitudinal axis
34 Arrangement
35 First end of the guide rail
36 Force sensor
37 Second end of the guide rail
41 Support means
42 Guide roller

What is claimed is:

1. Mounting device (1) for an all-steel card clothing (2) on a drum (3), comprising:

a frame (5), on which a mounting arm (4) is supported so as to be adjustable using a guide arrangement (11) in a direction of a rotational axis (6) of a drum (3) that is to be fitted with the all-steel card clothing (2), a guide rail (12) disposed to guide the guide arrangement (11) in a direction transverse to a direction of motion for the all-steel card clothing (2) toward the drum (3), a force measuring arrangement (21) configured to measure a force acting on the mounting arm (4) during the fitting operation by measuring force between the guide arrangement (11) having a guide carriage (13) and the mounting arm (4) by being mounted between the guide arrangement (11) and the mounting arm (4) to measure force with which the mounting arm (4) abuts against the guide carriage (13).

2. Mounting device as in claim 1, characterized in that the mounting arm (4) supports a brake arrangement (25), said brake arrangement being disposed to decelerate the all-steel card clothing (2) moving through the mounting device (1).

3. Mounting device as in claim 1, characterized in that the mounting arm (4) supports an alignment arrangement (28) for straightening the all-steel card clothing (2) passing through the mounting device (1).

4. Mounting device as in claim 1, characterized in that the mounting arm (4) supports a tilting device (32) for erecting the all-steel card clothing (2) passing through the mounting device (4).

5. Mounting device as in claim 1, characterized in that the force measuring arrangement (21) comprises a connecting arrangement (18) configured to connect the mounting arm (4) to the guide arrangement (11) so as to be freely movable in one direction (19).

6. Mounting device as in claim 1, characterized in that the force measuring arrangement (21) comprises a connecting arrangement (18) configured to connect the mounting arm (4) with the guide arrangement (11) so as to be movable in one direction (19) against a spring force.

7. Mounting device as in claim 5, characterized in that the connecting arrangement (18) comprises an elastically deformable element.

8. Mounting device as in claim 5, characterized in that the force measuring arrangement (21) is effective in the one direction (19).

9. Mounting device as in claim 6, characterized in that the force measuring arrangement (21) is effective in the one direction (19).

10. Mounting device as in claim 1, characterized in that the guide arrangement (11) comprises a stationarily supported guide rail (12) and the guide carriage (13).

11. Mounting device as in claim 10, characterized in that the guide carriage (13) is guided on the guide rail (12) so as to be movable in longitudinal direction and rotatable.

12. Mounting device as in claim 10, characterized in that the force measuring arrangement (21) is active between the guide carriage (13) and the guide rail (12).

13. Mounting device as in claim 1, characterized in that the force measuring arrangement (21) is active between the guide rail (12) and the frame (5).

14. Mounting device as in claim 1, characterized in that the drum (3) is associated with a drive motor (8).

* * * * *